US006447971B2

(12) United States Patent
Takezawa et al.

(10) Patent No.: US 6,447,971 B2
(45) Date of Patent: Sep. 10, 2002

(54) TONER CONTAINING RELEASE AGENT AND METHOD OF MANUFACTURING SAID TONER

(75) Inventors: Satoshi Takezawa; Tomoaki Tanaka, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/775,551

(22) Filed: Feb. 5, 2001

(30) Foreign Application Priority Data

Jun. 22, 2000 (JP) ..... 2000-188192

(51) Int. Cl.[7] ..... G03G 9/093
(52) U.S. Cl. ..... 430/110.2; 430/138
(58) Field of Search ..... 430/138, 110.2, 430/109.3, 137.17

(56) References Cited

U.S. PATENT DOCUMENTS

| | | | | |
|---|---|---|---|---|
| 4,912,010 A | * | 3/1990 | Mori et al. | 430/108.8 |
| 5,354,640 A | | 10/1994 | Kanbayashi et al. | 430/110 |
| 5,407,776 A | | 4/1995 | Kanbayashi et al. | |
| 5,741,617 A | * | 4/1998 | Inaba et al. | 430/108.4 |
| 5,827,632 A | | 10/1998 | Inaba et al. | |
| 5,935,751 A | | 8/1999 | Matsuoka et al. | |

FOREIGN PATENT DOCUMENTS

| | | |
|---|---|---|
| JP | 63-113560 | 5/1988 |
| JP | 4-63358 | 2/1992 |
| JP | 5-100486 | 4/1993 |
| JP | 5-197193 | 8/1993 |
| JP | 7-64335 | 3/1995 |
| JP | 8-227171 | 9/1996 |
| JP | 9-160292 | 6/1997 |
| JP | 9-319143 | 12/1997 |
| JP | 10-207116 | 8/1998 |
| JP | 11-7163 | 1/1999 |
| JP | 11-130813 | 5/1999 |
| JP | 11-295926 | 10/1999 |

* cited by examiner

*Primary Examiner*—John Goodrow
(74) *Attorney, Agent, or Firm*—Armstrong, Westerman & Hattori, LLP

(57) ABSTRACT

The present invention provides a toner that contains release agent, does not cause contamination in an electrophotographic apparatus, and has environmental stability and charge stability. This release agent-containing toner includes a center portion that contains low-polarity release agent and pigment, and a surface layer formed by a resin phase that covers the center portion.

12 Claims, 4 Drawing Sheets

TONER CONTAINING RELEASE AGENT AND METHOD OF MANUFACTURING SAID TONER

BACKGROUND OF THE INVENTION

1. Field of the Invention

The present invention relates to a toner used in an electrophotographic apparatus, such as an electrophotographic copying machine, an electrophotographic printer, or an electrostatic recording apparatus. The present invention also relates to a method of producing such a toner.

2. Description of the Related Art

FIG. 1 is a schematic view of the structure of an electrophotographic image forming apparatus. In this apparatus, electrostatic charges are uniformly induced on the photoconductive insulating member such as a photosensitive drum 10 by an electrostatic-charging device 20, and a light image 30 is emitted onto the photoconductive insulating member by a given manner, thereby forming an electrostatic latent image. Using colored fine particles called toner, the latent image is then developed into a toner image that is visible to the eye. The toner image is transferred onto a recording medium PA, such as paper, by a transfer unit 50, and fixed by a fixing unit 80, thereby obtaining a desired printed material. In the toner fixing process, the paper having the toner image fixed thereon passes through heating rollers 81, where the toner is melted and solidified. This is a so-called heat fixing method, which is the most widely used. The heat fixing method excels in simplification and cost performance, compared with other fixing methods.

In the heat fixing method, release agent (also referred to as "wax") is applied onto each toner particle so as to prevent the toner from adhering to the fixing members such as the heating rollers 81. Also, release agent such as silicone oil may be applied to the heating rollers 81 in the fixing unit 80 or some other members in the image forming apparatus. However, the release oil used for the apparatus gives glare to a fixed image formed on paper, and the mechanism for supplying the release oil complicates the structure of the fixing unit. In view of those problems, studies on techniques that involve no oil (oilless techniques) have been made. One of such oilless techniques involves an oilless toner that includes a large quantity of wax so that no fixing oil is necessary in the apparatus.

However, a toner is generally produced by melting and mixing resin, wax, and colorant, and then pulverizing the resultant material. If a toner containing a large quantity of wax is produced by a normal production method, the wax is liable to be exposed through the surfaces of the toner particles. As a result, the wax contained in the toner forms film and adheres to the photosensitive drum or the developing unit. This causes contamination on the photosensitive drum or the developing unit, and results in poor printing quality.

In view of the above problems, Japanese Laid-Open Patent Application No. 9-319143 discloses a technique for producing a toner having less exposed wax. In this technique, resin, colorant, and wax are melted and dispersed in an oily medium, and the oily mixture is dispersed in a water solvent so as to form oil droplets. After that, the oily medium is removed, thereby obtaining the toner having less exposed wax. However, in this technique, it is difficult to disperse the wax in the oily medium. Also, the use of the oily medium does not ensure safety in the toner production process.

Japanese Laid-Open Patent Application Nos. 63-113560 and 4-63358 both disclose a technique of producing a suspension polymerization toner that is obtained in the following manner. First, a monomer containing wax is heated to a temperature higher than the melting point of the wax, so that the wax is uniformly dispersed in the monomer. The monomer compound is dispersed in water and polymerized to obtain the suspension polymerization toner. However, the wax cannot completely be prevented from being exposed through the surfaces of toner particles. Further, Japanese Laid-Open Patent Application No. 5-197193 discloses a technique of producing a toner containing wax by a suspension polymerization method. However, in order to disperse the wax, the monomer provided with the wax is heated to a temperature higher than the melting point of the wax, which involves the danger of heating inflammable monomer in a bulk state. In this technique, the polymerization is carried out in the existence of pigments. As a result, polymerization trouble is easily impeded due to the existence of pigment, and there is also a problem with the rheology control. Furthermore, since the pigment is exposed through the surfaces of the toner particles produced by the above technique, the charge amount, which is an essential characteristic value of the toner, easily varies due to the pigment exposed through the surfaces.

Meanwhile, Japanese Laid-Open Patent Application No. 7-64335 discloses a toner that is colored resin particles containing wax. This toner is obtained in the following manner. Wax emulsion is mixed with an emulsion polymerization liquid obtained by emulsion-polymerizing a polymerization monomer. A salting-out process is then performed on the resultant. However, since the technique requires emulsion agent and salting-out agent both having hygroscopicity, the resultant toner also exhibits hygroscopicity and lacks environmental stability. Also, since the pigment is exposed through the surfaces of toner particles also in this technique, there will be a problem of charge instability.

SUMMARY OF THE INVENTION

A general object of the present invention is to provide toners containing release agent and method of producing the toners in which the above disadvantages are eliminated.

A more specific object of the present invention is to provide a toner that contains enough release agent for realizing oilless fixing of images, does not cause contamination in an electrophotographic apparatus, excels in production workability, and maintains environmental stability and charge stability. Another specific object of the present invention is to provide a method of producing the above toner.

The above objects of the present invention are achieved by a release agent-containing toner that comprises: a center portion that contains release agent and pigment; and a surface layer portion that is formed by a resin phase that covers the center portion.

With this release agent-containing toner, the problem of contamination in an electrophotographic apparatus can be prevented, because the release agent is not exposed through the surface of the toner particles. Thus, excellent printing quality can be expected. Also, since the pigment and the release agent are contained by the resin phase of the surface layer, excellent charge stability can be obtained. Furthermore, the release agent-containing toner excels in environmental stability, because no emulsifier having absorption properties was contained in the toner.

The above objects of the present invention are also achieved by a release agent-containing toner that comprises:

a center portion that contains release agent; and a surface layer portion that is formed by a resin phase containing dye that covers the center portion.

The above objects of the present invention are also achieved by a method of producing a release agent-containing toner, comprising the steps of:

dispersing release agent in a water-based medium, the release agent being insoluble in a polymerization monomer compound;

mixing the dispersed release agent with the polymerization monomer compound;

covering the polymerization monomer compound with dispersion particles of the release agent as a seed; and forming a surface layer of a resin phase by polymerizing the polymerization monomer compound.

Generally, compounds having polarities exhibit affinities to one another. For instance, a styrene- or acrylic-based polymerization monomer that is generally used is a material having relatively high polarity. In a water-based medium in which the emulsion of a polymerization monomer and low-polarity resin coexist, a small amount of polymerization monomer dissolved the water-based re-precipitates through the surface, with the dispersed particles of the low-polarity resin as seeds. More specifically, the monomer molecules move from the emulsion of the polymerization monomer to the particles of the low-polarity resin. The low-polarity resin particles and the polymerization monomer were compounded. The polymerization monomer covers the surface of the low-polarity resin particles, and increases the grain sizes of the particles. This phenomenon is referred to as "seed polymerization".

The present invention employs the above mechanism. More specifically, release agent that is insoluble to a polymerization monomer compound is selected as the low-polarity resin, and a toner is produced using the release agent. In accordance with the method of the present invention, the surfaces of the dispersed particles of the low-polarity release agent are covered with the polymerization monomer. The polymerization monomer on the surface is polymerized to form a resin phase on the surface layer. Thus, a release agent-containing toner is obtained.

If non-polarity release agent such as polyethylene or polypropylene is selected, the polymerization monomer concentrates on certain spots. With such non-polarity release agent, the release agent and the resin phase become separate from each other but still in contact with each other. In such a case, the release agent is exposed through the surface, and a toner using the release agent never has the same functions as the release agent-containing toner of the present invention.

In order to perform smoothly the toner production step of the present invention, the polymerization monomer compound and the low-polarity release agent should preferably be mixed after the polymerization monomer compound is processed to increase the total area. This process can be carried out by dispersing the polymerization monomer compound in a water-based medium so as to achieve an emulsified state.

The above and other objects and features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 2:
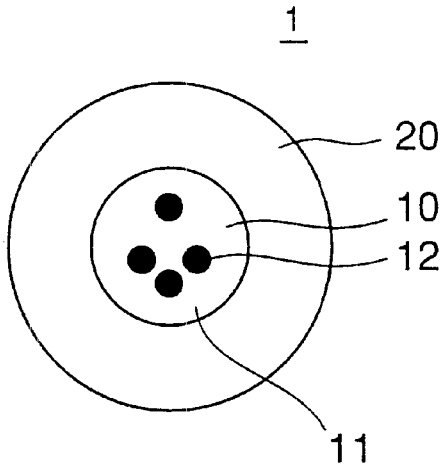
FIG. 2 is an enlarged schematic view of one particle of a toner containing release agent in accordance with the present invention.
Figure 3:
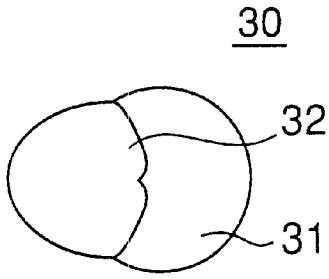
FIG. 3 is an enlarged schematic view of one particle of a toner containing non-polarity release agent.
Figure 4:
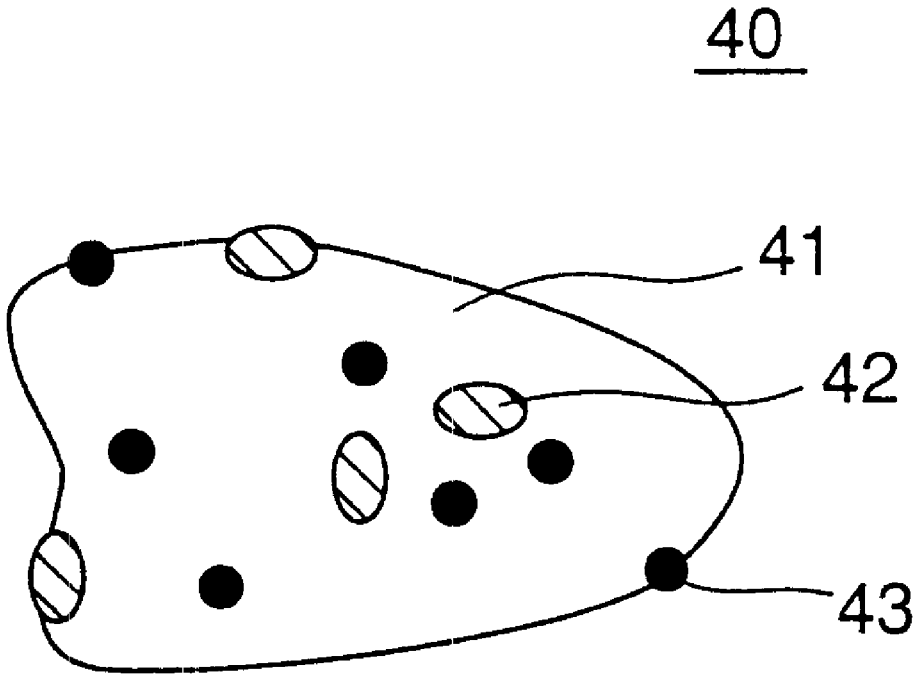
FIG. 4 is an enlarged schematic view of one particle of a conventional toner.

FIG. 2 is a schematic enlarged view of one particles of a toner containing release agent of the present invention. For comparison, FIG. 3 is a schematic enlarged view of one particle of a toner produced using non-polarity release agent. FIG. 4 is a schematic enlarged view of one particle of a conventional toner.

In FIG. 2, a toner 1 containing release agent comprises a center portion 10 and a surface layer 20 that externally covers the center portion 10 continuously. The center portion 10 is a mixture of a low-polarity release agent (or wax) 11 and pigment 12. The surface layer 20 outside the center portion 10 is a resin phase. This resin phase is formed by polymerizing a polymerization monomer that will be described later. The release agent-containing toner 1 has a uniform resin phase as the surface layer 20, which does not have the wax or pigment on its surface. Accordingly, this release agent-containing toner 1 causes no contamination in an electrophotographic apparatus, and excels in the charge stability and environmental stability.

A toner 30 shown in FIG. 3 is a half-separate type toner, with a resin portion 31 and a release agent portion 32 being separated and still in contact with each other. This toner 30 has the problem that the exposed release agent causes contamination in an electrophotographic apparatus.

A toner 40 containing the conventional release agent shown FIG. 4 has release agent 42 and pigment 43 are dispersed in a resin portion 41. The release agent 42 and the pigment 43 are highly likely to appear on the surface of the toner 40, and cause problems, such as contamination in an electrophotographic apparatus and charge instability in image formation.

Referring back to FIG. 2, the wax 11 used in the release agent-containing toner 1 should preferably be insoluble in a monomer compound of the resin phase 20 prior to the polymerization. The wax 11 is not strictly limited to certain materials, as long as it has a hydrophobic property, a high affinity with a monomer, and a low polarity. However, in view of the function as the release agent for a toner used in an electrophotographic process, the wax 11 should preferably be a material or a mixture of materials selected from the group consisting of fatty acid ester, paraffin wax, carnauba wax, amide-based wax, and acid-denatured polyethylene.

In order to provide a toner fixing property suitable for the release agent-containing toner 1, the softening temperature of the wax 11 should be 150° C. or lower. Also, in order to increase the polymerization stability when the monomer of the surface layer is polymerized to be the resin phase 20, the softening point of the wax 11 should be at least 10° C. higher than the polymerizing temperature of the monomer. If the wax is in the solid state at the time of monomer polymerization, polymerization reaction can be smoothly carried out.

The release agent-containing toner 1 is preferably produced after the wax 11 is prepared in the formed of wax suspension that is minutely dispersed in water. The wax suspension can be adjusted by minutely dispersing wax in a heated water-base medium by an emulsifier.

The size of dispersed grains in the wax suspension is not specifically limited, but the range of 1 $\mu$m to 5 $\mu$m is preferable. If the grain size is below this range, not only the grain size of the produced toner becomes small, but also the fixing property of the toner becomes poorer. If the grain size of the toner is above this range, the productivity of the toner becomes poorer.

A monomer for forming the resin phase 20 to cover the wax 11 can be formed by an ethylene-based or acrylic-based monomer containing one ethylenic unsaturated bond in one molecule, for instance.

Examples of such a monomer include styrene and derivatives thereof, such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-nonylstyrene, p-n-octylstyrene, p-n-hexylstyrene, p-n-dodecylstyrene or the like, ethylenically unsaturated monoolefin and dervatives thereof, such as ethylene, ptopylene, butylene, isobutylene or the like, halogenated vinyl monomer and derivatives thereof, such as vinyl chloride, vinylidene chloride, vinyl bromide, vinyl fluoride or the like, vinyl ester and derivatives thereof, such as vinyl acetate, vinyl propionate, vinyl benzoate or the like, $\alpha$-methylene aliphatic monocarboxylic acid ester and derivatives thereof, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate or the like, acrylate and derivatives thereof, such as methyl acrylate, ethyl acrylate, n-butyl acrylate, isobutyl acrylate or the like, vinyl ether and derivatives thereof, such as vinyl methyl ether, vinyl ethyl ether, vinyl isobutyl ether or the like, vinyl ketone and derivatives thereof, such as vinyl methyl ketone, vinyl hexyl ketone, methyl isopropenyl ketone or the like, N-vinyl compounds, such as N-vinyl pyrrole, N-vinyl carbazole, N-vinyl indole, N-vinyl pyrrolidone or the like, derivatives of acrylic acid and methacrylic acid, such as acrylonitrile, methacrylonitrile, acrylamide or the like. These compounds may be used alone or in combination.

For the purpose of controlling the molecular weight of the resin phase 20, the monomer is allowed to be subjected to polymerization treatment in conjunction with the crosslinking agent and the chain transfer agent. As the crosslinking agent, it is possible to use a compound having more than two unsaturated double bonds therein. More specifically, it may possible to use divinyl benzene, divinyl naphthalene and derivatives thereof, diethylenically unsaturated carboxylic acid esters, such as ethylene glycol dimethacrylate, diethylene glycol dimethacrylate or the like, divinyl compounds such as divinyl ether, N,N-divinyl amiline or the like. These compounds may be used alone or in combination.

Examples of such a chain transfer agent include mercaptan-based compounds, such as t-dodecylmercaptan, t-decylmercaptan, t-tetradecylmercaptan, halogen-based compounds, such as chloroform, trichlorobromomethane, carbon tetrachloride, carbon tetabromide or the like, diazothioether-based compounds, and the like.

In the production process of the release agent-containing toner 1, the wax 11 is used as a seed, and the monomer is formed so as to cover the surface of the wax 11. At this point, the liquid monomer in the form of oil droplets covers the surface of the solid wax 11. By subjecting the monomer to a polymerization process, the monomer is polymerized to form the resin phase 20.

The initiator for monomer polymerization may be any water-soluble or oil-soluble initiator, it is favorable to use the oil-soluble initiator from the viewpoint of inhibiting the particle generation of side reaction product in the water-base medium. Examples of such initiators include azo-based compounds, such as 2,2'-azobis(2,4-dimethylvaleronitrile), 2,2'-azobis(isobutylonitrile) or the like, peroxide-based compounds, such as benzoyl peroxide, lauroyl peroxide or the like. An amount of the initiator is between 0.01 and 10 parts by weight, more preferably between 0.05 and 7 parts by weight, based on 100 parts by weight of the monomer.

To restrict the generation of by-product grains in the water-base medium, a water soluble inhibitor, such as hydroquinone, may be added to the medium in the polymerization process.

For the purpose of improving stability of the droplet state of the oil in which the surface of the wax 11 mentioned above is covered with the liquid, it is also possible to use suspension-stabilizing agent. Examples of such agent include a hydrophilic polymer, such as poly(vinyl alcohol), poly(vinyl pyrrolidone), gelatin, methyl cellulose or the like, a non-aqueous inorganic powder, such as calcium triphosphate, barium sulfate, aluminium hydroxide, solica or the like, an anion- or nonion-based surfactant and the like. However, it is preferable to use the material having high hydrophilic character in order to facilitate the washing of the toner after polymerization.

Referring now to FIGS. 5A to 5D, a preferred example of the production processes of the release agent-containing toner of the present invention will be described below.

Figure 5A:
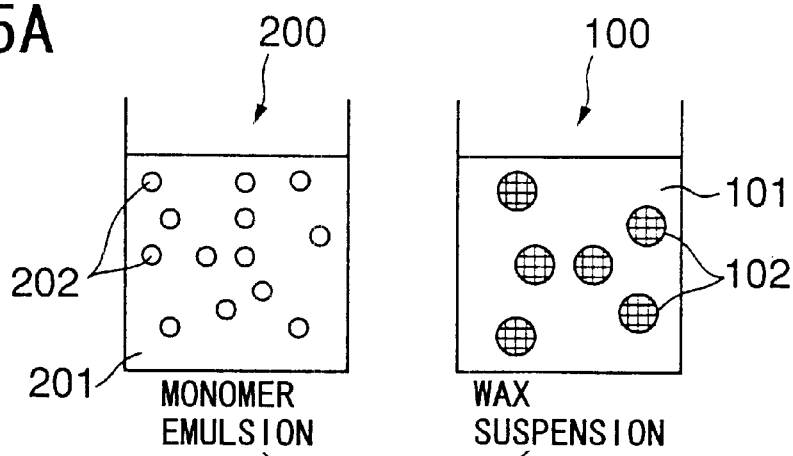
FIGS. 5A to 5D illustrate the production processes of the release agent-containing toner of the present invention.

FIG. 5A illustrates a process of dispersing a low-polarity wax that is insoluble to the monomer, and a process of increasing the total surface area of the monomer prior to the mixing.

A lump of wax is thrown into a water-based medium 101, and heated to a temperature higher than the softening point of the wax. Using a normal emulsifier, the wax is dispersed in the water-based medium 101 so as to obtain grains.

Prior to the dispersion step, the step of mixing the wax with pigment, the pigment can be dispersed in the wax in advance. The pigment used here is not specifically limited, but conventionally used pigment can be employed. In the right half of FIG. 5A, pigment dispersed wax particles 102 containing pigment is finely dispersed in the water-based medium 101, thereby forming a water-based suspension dispersion liquid (i.e., wax suspension) 100.

In parallel with the preparation of the water-based suspension dispersion liquid 100, the monomer to be mixed with the water-based suspension dispersion liquid 100 is also prepared. To facilitate the melting of the monomer into the water-solvent, a process should be performed in such a manner that the total surface area of the monomer increases. More specifically, as shown in the left half of FIG. 5A, minute monomer particles 202 are dispersed in the water-based medium 201, thereby obtaining monomer emulsion 200. The monomer particles 202 in the monomer emulsion 200 should be smaller than the wax particles 102 in diameter. If the grain size of the monomer particles 202 is larger than the wax particles 102, a part of the monomer particles does not cover the wax particles 102, resulting in by-product particles. Also, in order to restrict the generation of the by-product grains by emulsion polymerization having a different formation mechanism from the by-product grains, it is strongly preferable to perform the monomer emulsion at a surface active agent concentration lower than CMC (critical micelle concentration). The monomer emulsion process can be performed by a conventional rotor stator emulsifier, a high-pressure emulsifier, or a ultra-sonic emulsifier.

Figure 5B:
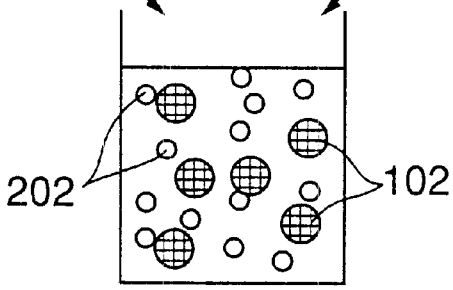

FIG. 5B shows a step of mixing the wax suspension 100 with the monomer emulsion 200. The monomer emulsion 200 is added to and mixed with the wax suspension 100, and then left at room temperature that is lower than the polymerization temperature or under predetermined cooling conditions over a predetermined period of time. Thus, the surfaces of the wax particles 102 are covered with the monomer.

Figure 5C:
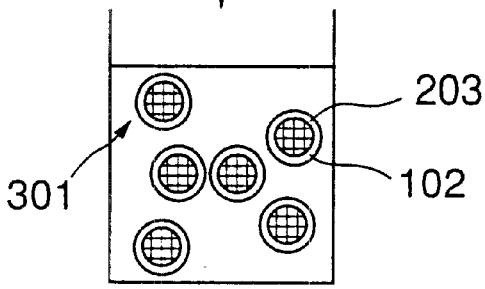

FIG. 5C shows the step of covering the monomer using the wax particles 102 as a seed. After the leaving after the mixing shown in FIG. 5B, the monomer particles 202 are melted in the water. The monomer 203 is then polymerized using again the wax particles 102 as a seed, so that the monomer 203 re-precipitates to cover the entire wax particles 102 as the seed. Thus, particles 301 having the monomer 203 covering the outer surfaces of the wax particles 102 can be obtained.

If the temperature in the covering step is almost the same as the temperature in the polymerization step, the monomer particles 202 are not polymerized with the wax particles 102, often resulting in suspension polymerization in the monomer emulsion state. Therefore, the temperature in the covering step should preferably be a temperature that is low enough not to freeze the water-based medium 101. The time required for covering step is normally several minutes to several hours.

At the end of the covering step, the monomer 203 covers the surfaces of the wax particles 102, and phase separation is caused between the monomer 203 and the wax particles 102. Thus, the monomer 203 forms oil droplets containing the wax particles 102.

Figure 1:
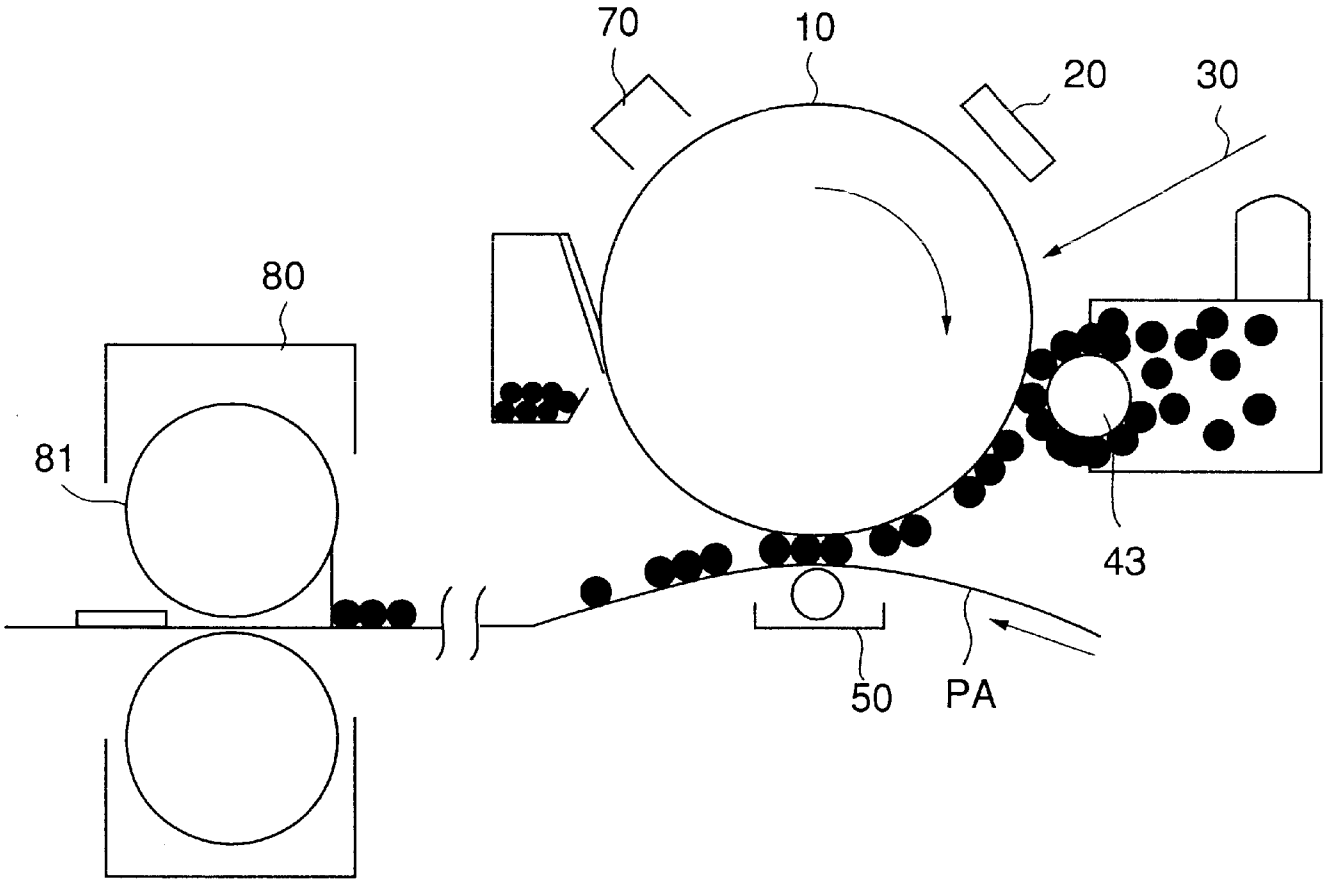
FIG. 1 is a schematic view of the structure of a conventional image forming apparatus.
Figure 5D:
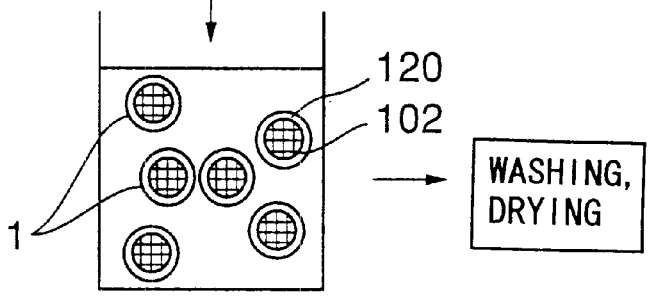

FIG. 5D shows the step of forming a surface layer by polymerizing the monomer 203. In this step, suspension stabilizer and water-soluble polymerization inhibitor are added when necessary, and then heated and subjected to light irradiation, thereby performing polymerization. During the polymerization, to prevent precipitation of particles 301, it is preferable to perform the polymerization while slowing stirring the liquid. In this step, the monomer 203 is polymerized and solidified, thereby forming the resin phase 120 as the surface layer. As a result, the state in which the release agent-containing toner 1 is dispersed in the water-based medium 101, as shown in FIG. 1. After that, the release agent-containing toner 1 is separated from the water-base medium 101, and then subjected to washing or drying. Thus, a toner that is suitable for electrophotography can be obtained.

The release agent-containing toner 1 contains wax and pigment at the center, but it is possible to color the surface of the release agent-containing toner 1 with dye, thereby combining the use of pigment and the use of dye. It is also possible to color the surface of the wax-containing toner 1 with dye after the formation of the toner 1, with the center portion containing only the wax, without performing the pigment mixing step prior to the dispersion step in FIG. 5A. In the present invention, after the resin phase 120 is formed on the surface of the toner 1, the coloring step is carried out. This coloring step should preferably be performed at a temperature higher than the glass transfer temperature of the resin phase 120, so as to increase the permeability of dye into the resin phase 120.

On the surface of the wax-containing toner 1 produced in the above manner, an external additive process is performed with non-organic particles such as silica or titanium oxide and resin particles, thereby obtaining a desired toner.

As being apparent from the above description, the wax-containing toner 1 can be easily and effectively produced using conventional equipment.

EXAMPLES

The following is a detailed description of examples of the present invention.

Example 1

One-hundred parts by weight of acid-denatured polyethylene having a temperature of 107° C., and 15 parts by weight of red pigment (pig. No. 184) were mixed by a double-axis mixer, thereby obtaining a pigment dispersed wax. Further, this wax was added in water maintained at 98° C., and a dispersion process was performed using a mixer at 2500 rpm for 30 minutes, thereby obtaining a pigment-containing wax suspension.

Meanwhile, in order to stabilize the emulsified state of the monomer, 0.1 part by weight of dodecyl sodium sulfate was dissolved in 750 parts by weight of pure water. Thus, a water-based medium was prepared. A monomer phase containing 65 parts by weight of styrene, 10 parts by weight of n-butyl acrylate, 0.2 part by weight of divinyl benzene, 4 parts by weight of azo-based initiator, was added in the water-based medium, thereby preparing monomer emulsion using a high-pressure homogenizer.

The monomer emulsion and 94 g of wax suspension (40% of the solid part) of the acid-denatured polyethylene were mixed and gently stirred at 5° C. for 2 hours. The wax particles and the monomer mixture were then compounded, and the surfaces of the wax particles were covered with the monomer.

Further, 0.5 part by weight of dodecyl sodium sulfate was added as a suspension stabilizer into the above suspension liquid, and the base was heated to 70° C. and polymerized for 8 hours.

After the polymerization, the resin fine particles obtained as a by-product in a small amount was removed by decantation, followed by washing and drying. A wax-containing toner was then completed by adding 1.0 wt % of RA200HS (produced by Nippon Aerosil) as external additive.

Example 2

One-hundred parts by weight of oxide-type Fischer-Tropsch WAX having a softening temperature of 95° C. and 15 parts by weight of blue pigment (pig. No. 15:3) were mixed by a double-axis mixer, thereby obtaining a pigment dispersed wax. This pigment dispersed wax was then added into water maintained at 98° C., and was dispersed by a mixer at 2500 rpm for 30 minutes, thereby obtaining pigment-containing wax suspension.

Meanwhile, 0.1 part by weight of dodecyl sodium sulfate was dissolved in 750 parts by weight of pure water, thereby preparing a water-based medium. A monomer phase that contains the mixture of 65 parts by weight of styrene, 10 parts by weight of 2-ethyhexyl acrylate, 0.1 part by weight of divinyl benzene, 3.5 parts by weight of azo-based initiator, was added to the water-based medium. Using a high-pressure homogenizer, a monomer emulsion was then prepared.

The monomer emulsion and 94 g of the pigment-containing wax suspension (40% of the solid part) were mixed and gently stirred at 5° C. for 2 hours, so that the wax particles and the monomer mixture were compounded. The surfaces of the wax particles were covered with the monomer.

Further, 0.5 part by weight of dodecyl sodium sulfate was added as a suspension stabilizer into the suspension liquid. The base was then heated to a temperature of 70° C., and polymerized for 8 hours. After the polymerization, a wax-containing toner was completed in the same manner as in Example 1.

Example 3

A water-base medium was prepared by dissolving 0.1 part by weight of dodecyl sodium sulfate in 750 parts by weight of pure water. A monomer phase that contains the mixture of 65 parts by weight of styrene, 10 parts by weight of n-butyl acrylate, 0.2 part by weight of divinyl benzene, 4 parts by weight of azo-based initiator, was added in the water medium. Using a high-pressure homogenizer, a monomer emulsion was then prepared.

This monomer emulsion and 94 g of wax suspension (40% of the solid part) of acid-denatured polyethylene were mixed and gently stirred at 5° C. for 2 hours. The wax particles and the monomer mixture were then compounded, and the surfaces of the wax particles were covered with the monomer.

Further, 0.5 part by weight of dodecyl sodium sulfate was added as a suspension stabilizer into the suspension liquid. The base was then heated to 70° C., and then polymerized for 8 hours.

After the polymerization, 2.5 parts by weight of dye (for instance, Miketon Polyester Red FB) were added into the resin particle dispersed liquid, and then stirred at 80° C. for 1 hour, thereby dying the particles. After the dying, the small amount of resin fine particles obtained as a by-produce and the residual dye crystal were removed by decantation. Further, the particles were washed and dried, and 1.0 wt % of RA200HS (Nippon Aerosil) was added as external additive, thereby completing a dyed wax-containing toner.

Comparative Example 1

This is a comparative example in which non-polarity release agent was used.

Instead of the acid-denatured polyethylene-based wax used in Examples 1 to 3, a polyethylene-based wax suspension having a softening temperature of 130 (40% of the solid part) was used, thereby producing toner particles in the same manner as in Example 1. When the toner particles were observed by an electronic microscope, it was found that the resin phase does not completely cover the surfaces of the wax particles, and the wax was exposed as shown in FIG. 3.

Comparative Example 2

This is a comparative example in which the monomer was added without emulsification.

The monomer was not emulsified, but was mixed with a wax suspension, with the phase separation existing between the water and the monomer. Polymerization was then carried out in the same manner as in Example 1. As a result, the insufficient compounding of the monomer to the surfaces of the wax particles was found, i.e., many toner particles were not sufficiently covered with the monomer.

Printing Tests

Using the wax-containing toners of Examples 1 to 3, printing tests were conducted.

The color toners of Examples 1 to 3 were mixed with Magnetite Carrier (GF330, manufactured by Kanto Denka Kogyo, Co., Ltd.) at a toner concentration of 3%, thereby obtaining a developer. The charge amount of each toner was approximately −20 $\mu$C/g. The developer was disposed on an oilless-type machine that had been modified from a fixing machine of an electrophotographic printer F6671V (manufactured by Fujitsu Ltd.), and printing tests were carried out. As a result, there was no contamination caused by filming due to offset of the wax, and images that exhibit excellent fixing properties were obtained.

The present invention is not limited to the specifically disclosed embodiments, but variations and modifications may be made without departing from the scope of the present invention.

The present application is based on Japanese priority application No. 2000-188192, filed on Jun. 22, 2000, the entire contents of which are hereby incorporated by reference.

What is claimed is:

1. A release agent-containing toner, comprising:

a center portion that contains release agent and pigment; and a surface layer portion that is formed by a resin phase that covers the center portion, said surface layer portion being substantially free from said pigment.

2. The release agent-containing toner as claimed in claim 1, wherein the surface layer covers substantially the entirety of a surface of the center portion continuously.

3. The release agent-containing toner as claimed in claim 1, wherein the release agent has polarity.

4. A release agent-containing toner, comprising:

a center portion that contains release agent; and a surface layer portion that is formed by a resin phase containing dye that covers the center portion, said surface layer portion being substantially free from pigment.

5. The release agent-containing toner as claimed in claim 4, wherein the surface layer covers substantially the entirety of a surface of the center portion continuously.

6. The release agent-containing toner as claimed in claim 4, wherein the release agent has polarity.

7. The release agent-containing toner as claimed in claim 1, wherein the release agent is a material or a mixture of materials selected from a group consisting of fatty acid ester, paraffin wax, carnauba wax, amide-based wax, and acid-denatured polyethylene.

8. The release agent-containing toner as claimed in claim 4, wherein the release agent is a material or a mixture of materials selected from a group consisting of fatty acid ester, paraffin wax, carnauba wax, amide-based wax, and acid-denatured polyethylene.

9. A method of producing a release agent-containing toner, comprising the steps of:

dispersing release agent in a water-based medium, the release agent being insoluble in a polymerization monomer compound;

mixing the dispersed release agent with the polymerization monomer compound;

covering the polymerization monomer compound with dispersion particles of the release agent as a seed; and forming a surface layer of a resin phase by polymerizing the polymerization monomer compound, said surface layer being substantially free from pigment.

10. The method as claimed in claim 9, wherein the polymerization monomer compound is processed in such a manner that the total area increases, and then mixed with the release agent.

11. The method as claimed in claim 9, further comprising the step of mixing the release agent with pigment prior to the step of dispersing.

12. The method as claimed in claim 9, further comprising the step of coloring the resin phase with dye after the step of forming the surface layer.

* * * * *